United States Patent [19]

Marriott

[11] Patent Number: 4,790,122

[45] Date of Patent: Dec. 13, 1988

[54] KICK PAD FOR REMOVING DEBRIS FROM FOOTWEAR

[76] Inventor: Joseph W. Marriott, 32 Birch Ct., Burlington, Vt. 05401

[21] Appl. No.: 80,067

[22] Filed: Jul. 31, 1987

[51] Int. Cl.[4] ..... E04N 14/00

[52] U.S. Cl. ..... 52/173 R; 52/750; 16/1 R; 16/DIG. 2; 15/237

[58] Field of Search ..... 52/37, 173, 750, 202; 16/1 R, DIG. 2, 237; 248/345.1

[56] References Cited

U.S. PATENT DOCUMENTS

| | | | |
|---|---|---|---|
| 1,709,911 | 4/1929 | Hyams | 16/DIG. 2 |
| 2,051,531 | 8/1936 | Roberts | 49/460 |
| 2,692,144 | 10/1954 | Wofford | 15/237 |
| 3,173,826 | 3/1965 | Campbell et al. | 248/345.1 |
| 3,531,816 | 10/1970 | Engel | 15/237 |
| 3,785,102 | 1/1974 | Amos | 52/173 |

FOREIGN PATENT DOCUMENTS

| | | | |
|---|---|---|---|
| 593432 | 3/1960 | Canada | 16/DIG. 2 |

*Primary Examiner*—James l. Ridgill, Jr.

*Attorney, Agent, or Firm*—Burns, Doane, Swecker & Mathis

[57] ABSTRACT

A rectangular shaped pad is mounted on a building in an area adjacent the doorframe to protect the building from damage due to kicking by persons trying to remove devris from their footwear upon entering the building. The pad can be mounted below the doorframe where the doorframe is raised above the entrance to the building or the pad can be mounted on either side of the doorframe where the doorframe is level with the entrance to the building.

4 Claims, 1 Drawing Sheet

KICK PAD FOR REMOVING DEBRIS FROM FOOTWEAR

BACKGROUND OF THE INVENTION

This invention relates generally to a device for protecting the exterior of a house and more particularly to a rubber pad which can be mounted adjacent a doorframe and used to remove debris from the footwear of a person entering the house by kicking the pad with his or her foot.

BACKGROUND DESCRIPTION

In many types of weather, e.g., snow, sleet, freezing rain, mud, etc., upon entering a building most people will remove debris from their footwear by kicking the area directly under the door casing. Eventually this area will become marred, chipped, or cracked and require replacement or repair. This is especially so in cooler regions where there may be snow on the ground as long as six months each year.

A conventional doormat has been used to remove debris from footwear. The conventional doormat lies flat on an area in front of the entrance and is usually made of rubber. Removal of debris from footwear is performed by sliding a person's foot back and forth over the doormat. However, this action tends to pack debris into the crevices of footwear with traction-treaded soles. Once inside the house the packed debris can loosen up and become deposited within the interior of the house.

The foregoing illustrates limitations known to exist in present devices. Thus, it is apparent that it would be advantageous to provide an alternative structure directed to overcoming one or more of the limitations set forth above.

Therefore, it is an object of the present invention to provide a pad which will protect the exterior of a house from kicking of the area adjacent a doorframe of the house to remove debris from footwear.

It is another object to provide a device which is small, easy to manufacture, and inexpensive.

It is a further object of the invention to provide a device which will absorb the shock caused by the kicking of one's feet for the removal of debris.

SUMMARY OF THE INVENTION

In one aspect of the present invention, this is accomplished by providing a kick pad for protecting the area adjacent the doorframe of a house from kicking by a person trying to remove debris from their footwear. The kick pad is comprised of a rectangular shaped pad mounted on the area adjacent the doorframe of a house and includes means for mounting the pad.

Other objects, features, and advantages of the present invention will become more apparent in light of the following description of the preferred embodiment, as illustrated in the accompanying drawing.

DESCRIPTION OF THE PREFERRED EMBODIMENT

Figure 1:
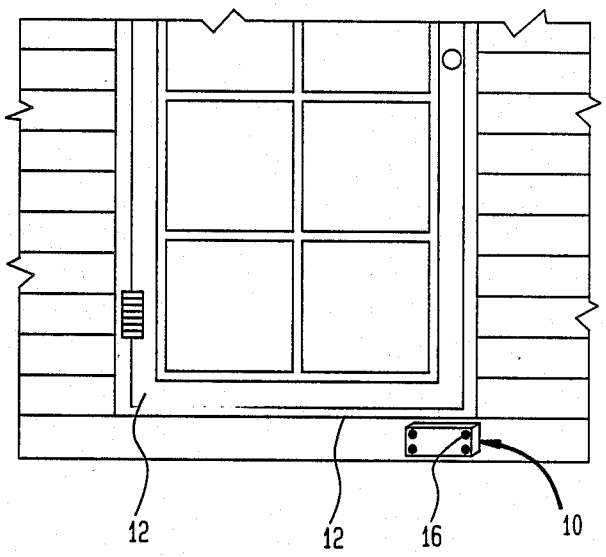
FIG. 1 is a pictorial view of a first embodiment of the structural arrangement of the present invention.
Figure 2:
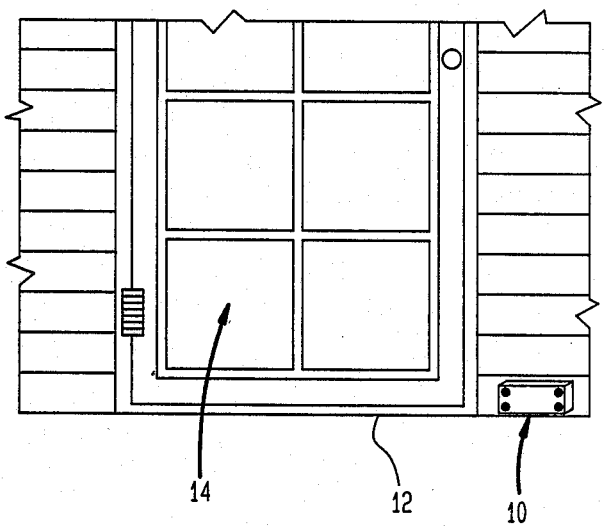
FIG. 2 is a pictorial view of a second embodiment of the structural arrangement of the present invention.

Referring to FIG. 1 a preferred embodiment of the kick pad 10 of the present invention is shown mounted on an area below the doorframe 12 of a house. This area directly beneath the doorframe 12 is a likely target for persons to, before entering the house, attempt to remove debris from their footwear by kicking the structure of the house. Eventually the area below the doorframe 12 will become marred, chipped, or cracked and require replacement and/or repair. This can be prevented by mounting the kick pad 10 so that persons entering the house have easy access to the pad. The kick pad 10 may be constructed of a medium to hard molded rubber. Preferred dimensions of the kick pad 10 are $\frac{5}{8}$ inches thick by $7\frac{3}{8}$ inches wide by $2\frac{3}{8}$ inches long. These dimensions offer a wide area to kick ($7\frac{3}{8}$ inches) and also allow the force from a kick to be distributed over a large area below the doorframe 12. Without this pad the force from a kick would not be dampened and would be concentrated at a small area immediately in front of the toe part of the shoe. This would cause the area to deteriorate quickly. On a level entrance to the house, a kick pad 10 could be mounted on either side of the doorframe 12 as shown in FIG. 2. If the door 14 opened in the opposite direction as that indicated in FIGS. 1 and 2, the kick pad 10 would also be mounted on the opposite side of the doorframe 12. The molded rubber of the kick pad 10 will create enough resistance to a person's foot to dislodge any debris from crevices in the treaded soles while providing enough cushion to protect the area below the doorframe.

The kick pad 10 can be mounted simply with four recessed screws 16 or other similar means. Its simple installation will eliminate the need to repair or maintain the area under entrances to houses where there is an abundance of traffic, while offering those who are entering the convenience and accessibility of an area to remove debris without damaging the exterior of the house. The kick pad 10 will absorb the shock due to removal of debris from footwear by kicking it without damaging the area directly behind it. The kick pad 10 can be made in an array of colors to conform to any exterior shade of a house it is being used on.

Although the invention has been described and shown with respect to a preferred embodiment thereof, it should be understood by those skilled in the art that the foregoing and other changes, omissions, and additions in the form and detail thereof may be made therein, without departing from the spirit and scope of the invention.

I claim:

1. A structural arrangement for minimizing damage to a building, due to kicking by persons trying to remove debris from their footwear upon entering, in an area adjacent the doorframe, comprising:

a rectangular shaped pad mounted on the exterior of a building in an area adjacent the location of the doorframe; and means for mounting said pad onto an exterior wall of the building.

2. The structural arrangement as claimed in claim 1, wherein said pad is mounted below the doorframe of a building where the doorframe is raised above the entrance to the building.

3. The structural arrangement as claimed in claim 1 wherein said pad is mounted to either side of the doorframe of a building where the doorframe is level with the entrance to the building.

4. The structural arrangement as claimed in claim 1, wherein said pad is made of rubber.

* * * * *